US010294674B2

(12) United States Patent
Guo

(10) Patent No.: US 10,294,674 B2
(45) Date of Patent: May 21, 2019

(54) RAIL CONNECTOR

(71) Applicant: James J. Guo, Odenton, MD (US)

(72) Inventor: James J. Guo, Odenton, MD (US)

( * ) Notice: Subject to any disclaimer, the term of this patent is extended or adjusted under 35 U.S.C. 154(b) by 252 days.

(21) Appl. No.: 15/592,333

(22) Filed: May 11, 2017

(65) Prior Publication Data

US 2018/0030734 A1 Feb. 1, 2018

Related U.S. Application Data

(60) Provisional application No. 62/367,884, filed on Jul. 28, 2016.

(51) Int. Cl.
*E04F 11/18* (2006.01)
*E04H 17/14* (2006.01)

(52) U.S. Cl.
CPC ..... *E04F 11/1834* (2013.01); *E04F 11/1812* (2013.01); *E04H 17/1421* (2013.01); *E04H 2017/1491* (2013.01)

(58) Field of Classification Search
CPC ..... E04F 11/18; E04F 11/181; E04F 11/1814; E04F 11/1812; E04F 11/1834
See application file for complete search history.

(56) References Cited

U.S. PATENT DOCUMENTS 3,648,982 A * 3/1972 Sabel ..... E04F 11/1834 256/22
4,125,249 A * 11/1978 Zen ..... E04F 11/1834 256/67
4,886,245 A * 12/1989 Manzo ..... E04F 11/1834 256/67
5,026,028 A * 6/1991 Ooi ..... E04F 11/1834 248/251
5,551,669 A * 9/1996 Reinklou ..... E04G 5/14 182/113
5,913,508 A * 6/1999 Eades ..... E04G 5/14 256/65.06
7,044,448 B1 * 5/2006 Jones ..... E04F 11/181 256/19
7,175,234 B1 * 2/2007 Hsieh ..... A47C 9/06 297/313
9,322,180 B2 * 4/2016 Burt ..... E04F 11/1834
2003/0234391 A1 * 12/2003 Sheppard ..... E04F 11/1834 256/67
2006/0033093 A1 * 2/2006 Lo ..... E04H 17/1443 256/65.02

* cited by examiner

*Primary Examiner* — Daniel J Wiley

(74) *Attorney, Agent, or Firm* — Laubscher & Laubscher, P.C.

(57) ABSTRACT

A rail connector includes a base and an outwardly extending projection rotatably connected with the base. The base has a flat lower portion and an upper portion which contains an opening that is parallel to the base lower portion. The projection includes upper and lower ends, the lower end being arranged in the base opening and the upper end having a threaded outer surface and extending outwardly from the base. The base is connected with a rail and the projection is connected with a baluster. The projection is rotatable relative to the base and allows the baluster to pivot to a desired angle.

7 Claims, 6 Drawing Sheets

RAIL CONNECTOR

This application claims the benefit of U.S. provisional patent application No. 62/367,884 filed Jul. 28, 2016.

BACKGROUND OF THE INVENTION

In both residential and commercial buildings, hand rails and guard rails are used for safety and aesthetic purposes. The rails can be used as a form of assistance when ascending or descending stairs, or they can also be used in the place of a wall, which allows for a room, deck or other portion of a building to be open rather than closed off. Rails can be supported by multiple balusters, which connect with the rails in different ways, whether by inserting a baluster directly into a rail or by inserting it into a connector that affixes to the rail. The baluster runs from the rail at an angle toward the floor, and then connects with either another piece of the rail system, such as a shoe rail, or the floor. The balusters are typically equidistant from one another. Balusters and the rails with which they are connected are usually stationary and built without the ability to move or adjust the angle between the balusters and rail. This requires that the rail system be constructed specifically for the location where it will be installed.

BRIEF DESCRIPTION OF PRIOR ART

A baluster can be connected to a rail by directly inserting it into the rail. This requires an opening within the rail. The opening must be precisely angled to assure that each baluster connects at the proper angle so it can then properly connect to the floor or shoe rail below. If the balusters are not properly angled, the rail system will not function as it should and it will not be aesthetically pleasing.

A baluster can also be connected to a rail by inserting it into a separate, connector piece, which is affixed to the rail and has a set angle. This adds some consistency and ease when compared to directly inserting the baluster into the rail, but the pieces, and how they are angled, are set in one place and cannot be adjusted.

SUMMARY OF THE INVENTION

It is a primary object of the present invention to provide a rail connector that rotatably connects a baluster with a rail, and allows the baluster to be pivoted to a desired angle. The rail connector facilitates the installation of an angled rail system, typically associated with stairs or a ramp, but it can also be used with a rail system having no angle. The rail connector is adaptable to be used with numerous different rail systems and angles.

In one preferred embodiment, the rail connector includes a base and an outwardly extending projection rotatably connected to the base. The base has a flat lower portion and an upper portion which contains an opening that is parallel to the base lower portion. The projection includes upper and lower portions, the lower portion being arranged in the base opening, and the upper portion having a threaded outer surface and extending outwardly from the base. The base connects with a rail and the projection connects with an opening at the end of a baluster. The projection is rotatable relative to the base and allows the baluster to pivot to a desired angle.

In another embodiment, the projection lower portion is cylindrical and the base upper portion is circular. Further, the base lower portion includes a lower flange arranged beneath the upper portion opening, and the base upper portion includes a pair of spaced arches between which the projection upper portion extends. At an outer edge of each of the arches there is at least one flange that closes the opening.

In another embodiment, the projection upper end connects with an insert rather than with a baluster, and the insert then connects with a baluster. The insert connects with the projection upper end via an opening, and connects with the baluster via a wedge connection at the baluster opening.

In yet another embodiment, the outer surface of the insert has at least one projection to increase a compression force on the insert when it is wedged within the baluster opening.

BRIEF DESCRIPTION OF THE FIGURES

Other objects and advantages of the invention will become apparent from a study of the following specification when viewed in the light of the accompanying drawing in which.

DETAILED DESCRIPTION

The present invention relates broadly to rail systems, and more specifically to a rail connector that connects a baluster to a rail. Referring to FIGS. 1-9 a connector 2 for connecting a rail with a baluster which can freely adjust its angle relative to a rail is shown. The connector includes a base 4 and a projection 6 rotatably connected with the base.

Figure 1:
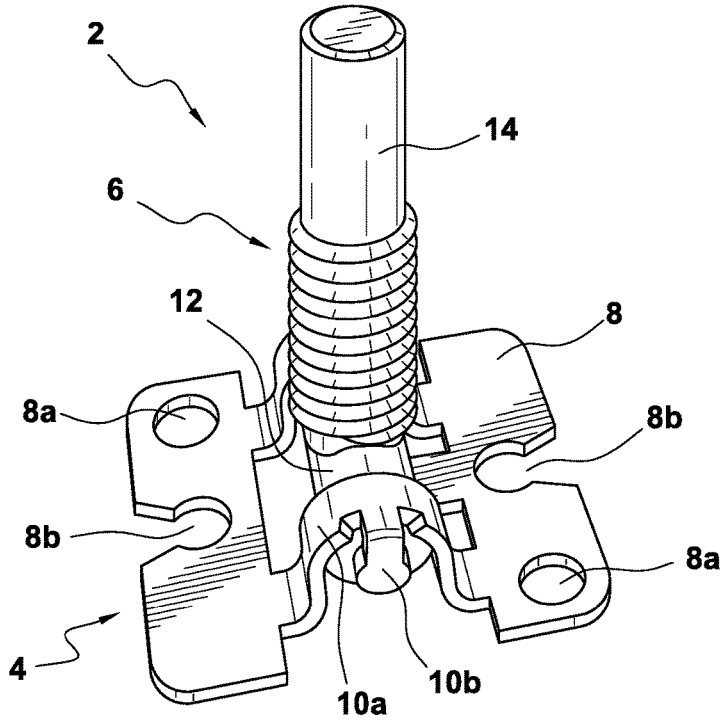
FIG. 1 is a perspective view of a rail system connector that pivots according to the invention.
Figure 2:
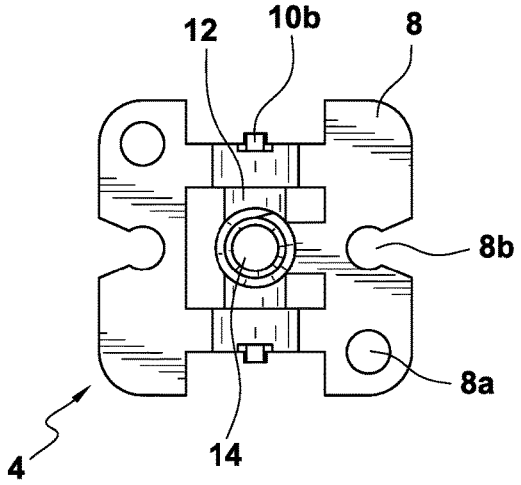
FIG. 2 is a top plan view of the connector.
Figure 3:
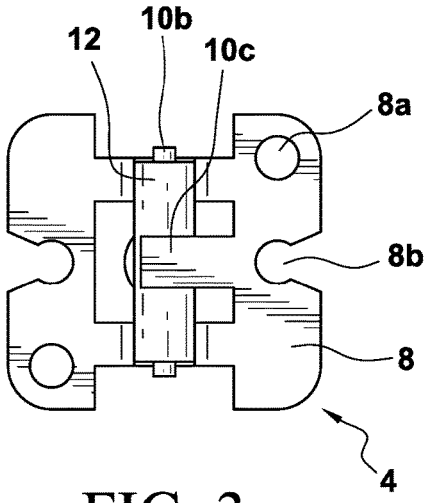
FIG. 3 is a bottom plan view of the connector.
Figure 4:
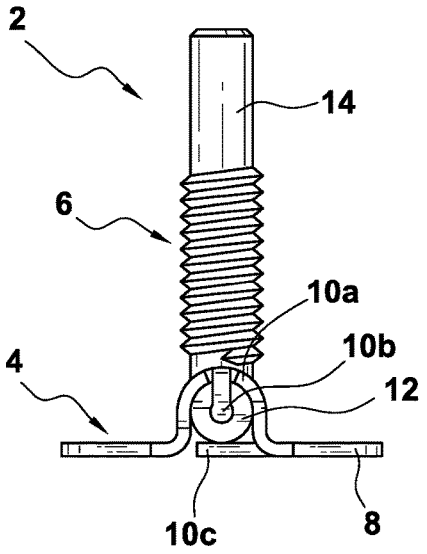
FIGS. 4 and 5 are right and left side plan views, respectively, of the connector.
Figure 5:
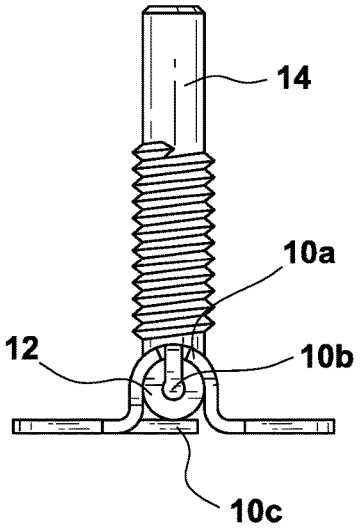
Figure 6:
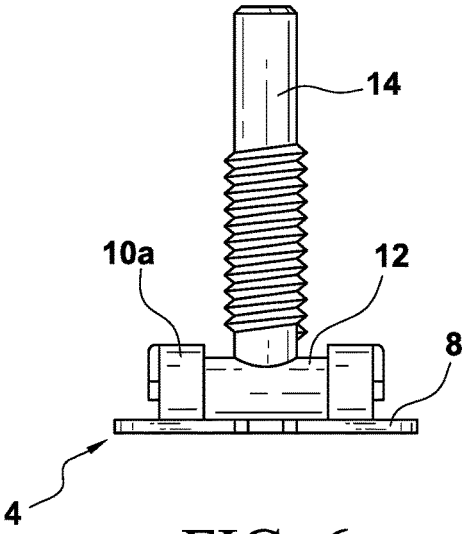
FIGS. 6 and 7 are side plan views, respectively, of the connector.
Figure 7:
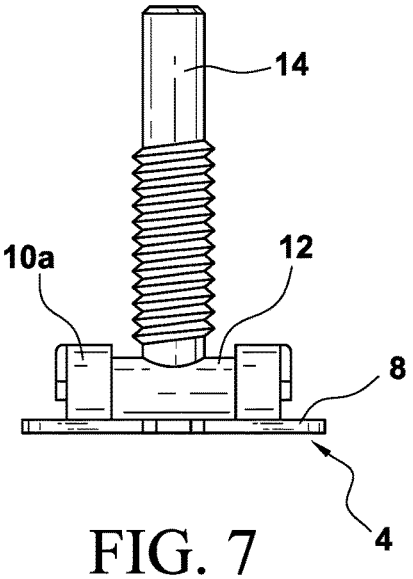

More particularly, the base includes a lower portion 8 and an upper portion 10. The lower portion is flat and includes a plurality of openings 8*a* and recesses 8*b*, as shown in FIGS. 1-3, both of which are for receiving fastening devices.

As shown in FIGS. 1-7, the base upper portion includes a pair of spaced arches 10*a*, a pair of outer flanges 10*b*, and a lower flange 10*c*. The outer flanges 10*b* extend from an outer edge of the spaced arches 10*a*, and the lower flange 10*c* extends from the base lower portion 8. The arches, outer flanges, and lower flange define an opening.

The projection 6 includes a lower end 12 and an upper end 14. The lower end is cylindrical and is held within the opening of the base upper portion 10. The projection upper end 14 is cylindrical and threaded, and extends outwardly from the projection lower end 12.

Figure 8:
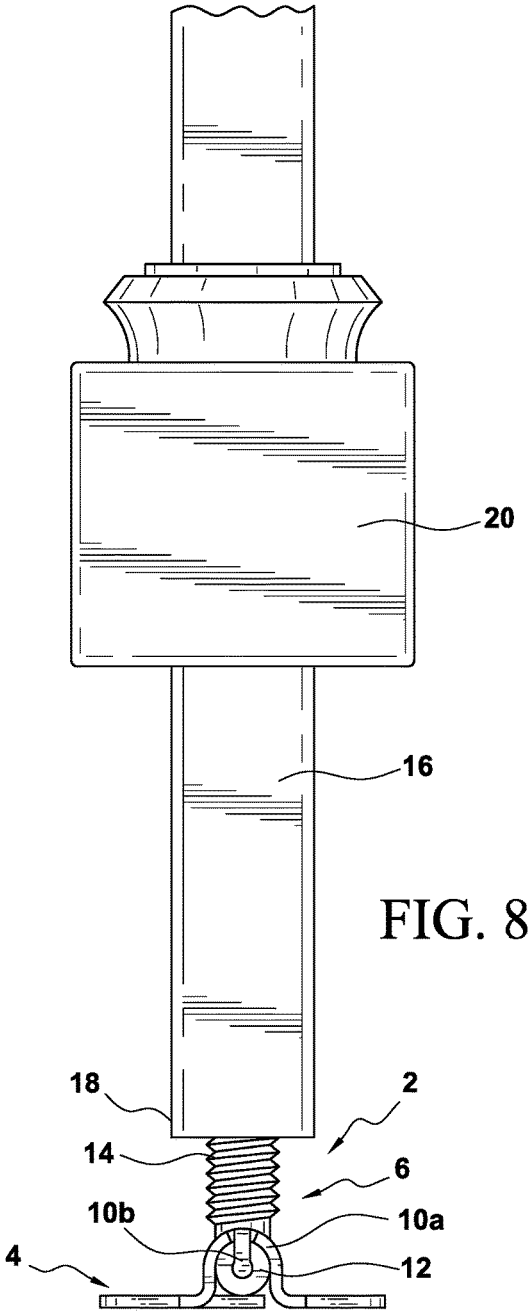
FIG. 8 is an exploded side view of the connector connected with a baluster.
Figure 9:
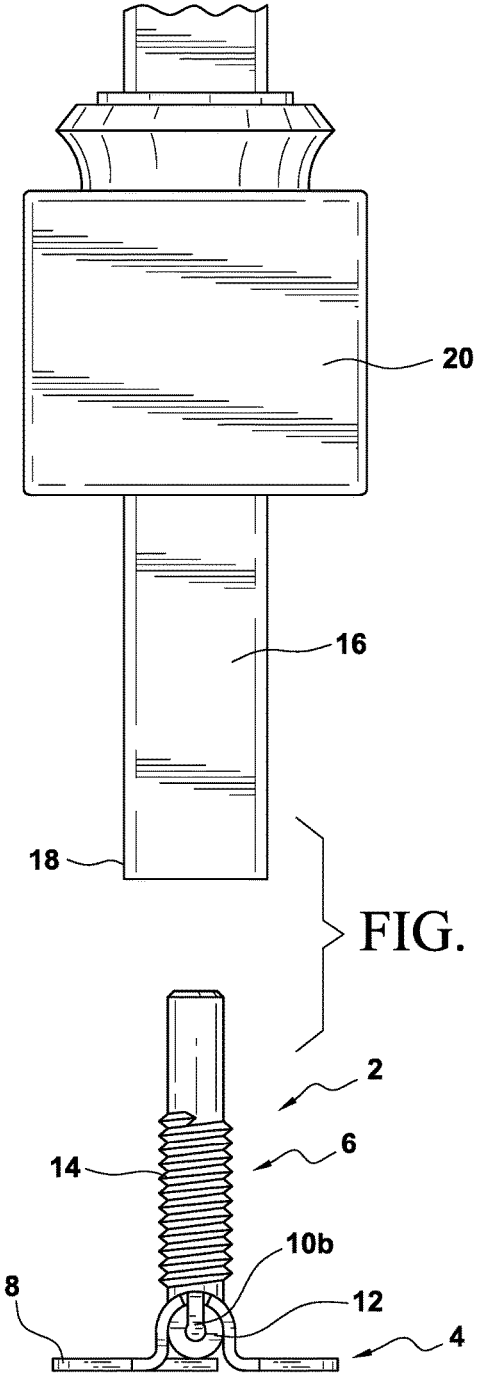
FIG. 9 is a side view of the connector and a baluster.

Referring now to FIGS. 8 and 9, the rail connector 2 is shown with a baluster 16. The baluster has a lower end 18 with a threaded opening (not shown) for receiving the projection upper end 14. Once the baluster is connected to the rail connector 2, the projection 6 rotates relative to the base 4, allowing for the baluster 16 to be placed at a desired angle. As is readily apparent, the degree of rotation is limited by the base, so that the projection rotates generally through 180° between positions where the axis of the threaded portion is parallel to the base and intermediate positions where the axis of the threaded portion is at an angle relative to the base. Preferably, a connector is threadably connected with each end of the baluster.

The connector can be covered by a baluster shoe 20 which slides along the baluster and is fastened over the connector via a snap-fit or other suitable connection.

Figure 10:
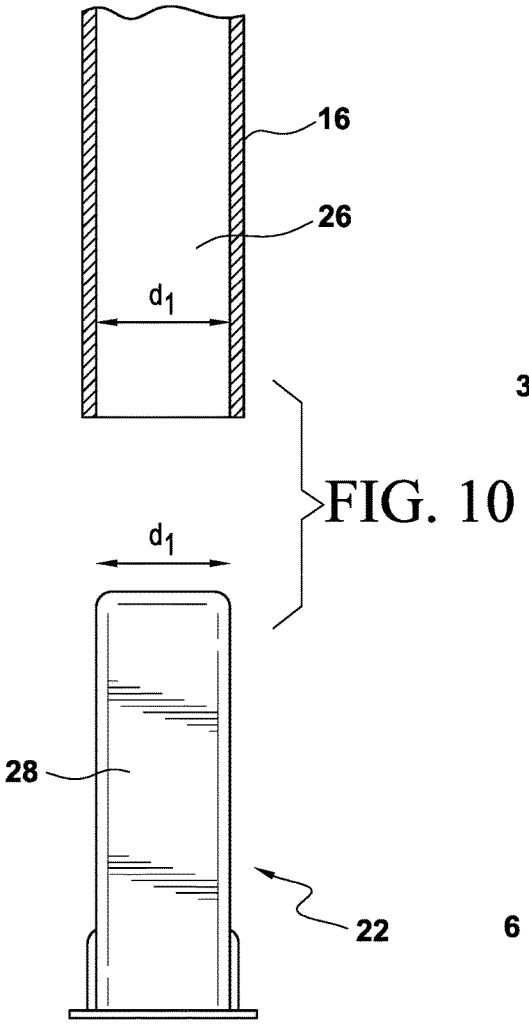
FIG. 10 is an exploded side view of a first embodiment of the rail connector insert and a baluster.
Figure 11:
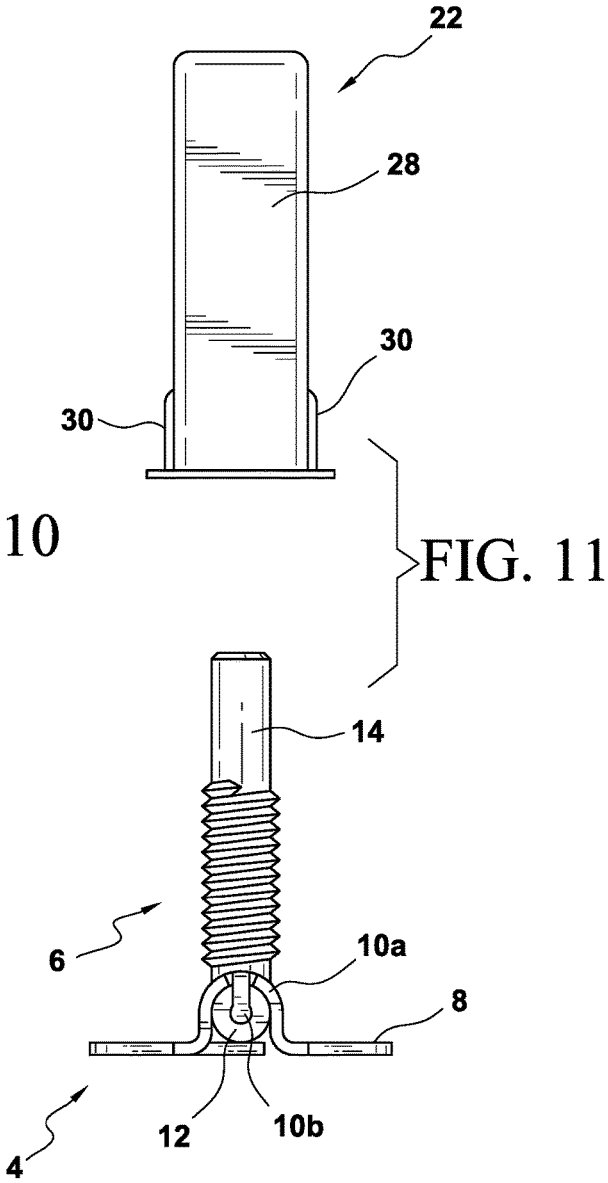
FIG. 11 is an exploded side view of the connector with the insert of FIG. 10.

FIGS. 10-15 show an insert 22 that connects with the rail connector 2 and baluster 16. Preferably, the insert is used with a metal baluster that has openings at either end. The insert 22 is configured to fit within the baluster opening. In such metal balusters, the projection upper end 14 cannot be threadably connected with the baluster, and therefore the insert is used for connecting the two. The insert has a threaded opening 24 at each end and is threadably connected to the projection upper end 14, as shown in FIG. 11. It will be apparent to those skilled in the art that the insert opening 24 can be smooth rather than threaded, and the projection upper end 14 of the connector 2 can be self-tapping.

As shown in FIG. 10, the insert 22 is connected with a baluster 16 via a press-fit or wedge connection. The baluster includes an inner opening 26 and the insert has an outer surface 28 whose configuration corresponds with that of the baluster opening. The baluster inner opening 26 has a width $d_1$ that corresponds with the width $d_1$ of the insert out configuration.

The insert outer surface 28 has a plurality of projections or ridges 30 which increase the compression force on the insert when the insert is wedged into the baluster opening.

Figure 12:
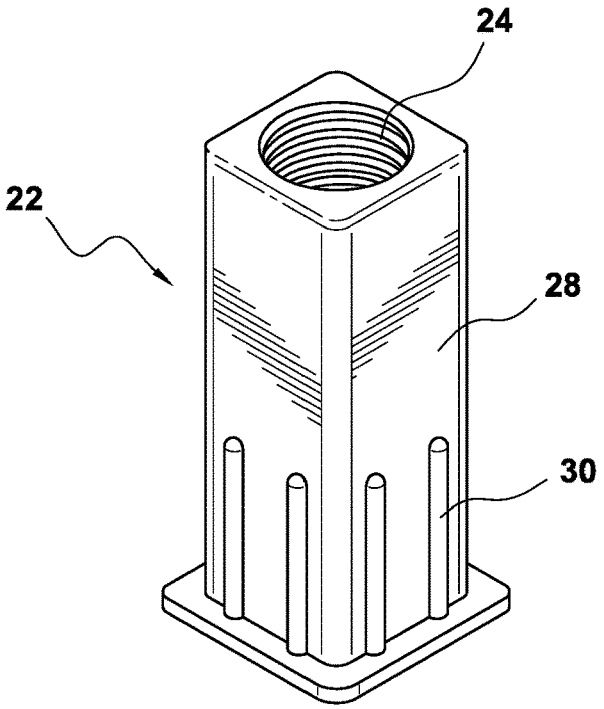
FIGS. 12 and 13 are top and front perspective views, respectively, of the insert.
Figure 13:
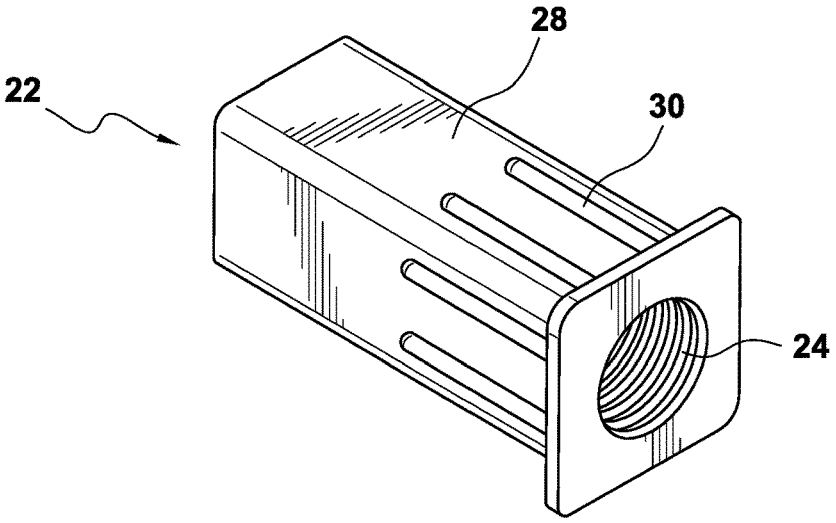
Figure 14:
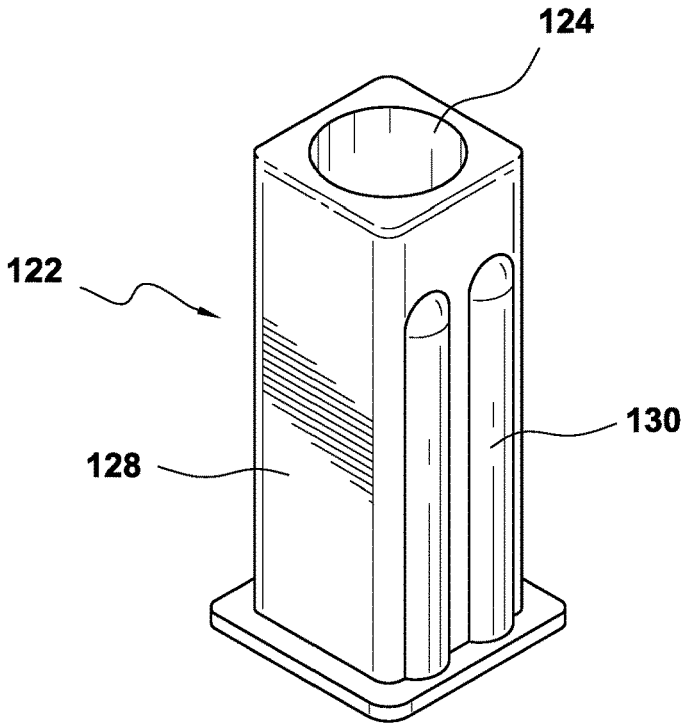
FIGS. 14 and 15 are top and front perspective views, respectively, of an alternate embodiment of the insert.
Figure 15:
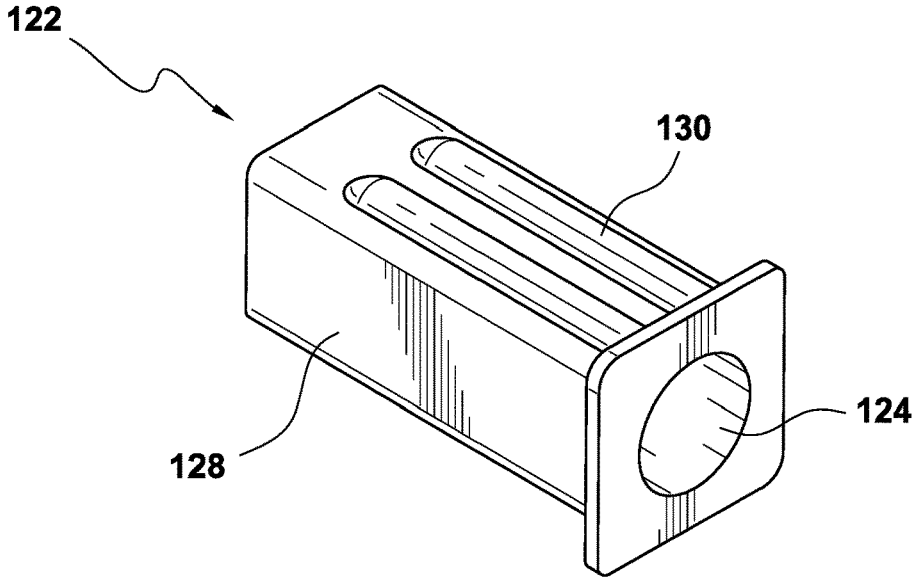

FIGS. 14 and 15 show an alternate embodiment of the insert 122, which includes an outer surface 128 with a plurality of projections or ridges 130 that are substantially wider and longer than the ridges on the inserts of FIGS. 12 and 13. FIG. 15 shows the insert with a smooth inner surface at its opening 124 for receiving a projection upper end 14. It will be apparent to those skilled in the art that the opening 14 of the insert shown in FIGS. 14 and 15 can be threaded rather than smooth.

In operation, a baluster having openings at both ends is positioned between two rails. The bases of the connectors are positioned at desired locations along each rail, with the projection upper end being freely rotatable relative to the base. The baluster is arranged in vertical alignment relative to an adjacent baluster and is connected with the projection upper end via a threadable connection or via the wedge insert. The bases are fastened to the rails to hold the baluster in place, and a cover is positioned to cover the rail connector.

The rail connector is formed of any suitable rigid and durable material such as metal or synthetic plastic.

The insert is formed of a synthetic plastic material. It has a limited degree of flexure which allows the insert to be arranged within the baluster opening 26 in a press-fit or wedging connection.

While the preferred forms and embodiments of the invention have been illustrated and described, it will be apparent to those of ordinary skill in the art that various changes and modifications may be made without deviating from the inventive concepts set forth above.

What is claimed is:

1. A rail connector, comprising:

(a) a base including a flat lower portion and an upper portion containing an opening extending parallel to said base lower portion; and (b) a projection rotatably connected with said base, said projection including a lower portion arranged within said base upper portion opening and a cylindrical upper portion having an axis normal to said projection lower portion, said projection upper portion having a threaded outer surface; and (c) an insert having an opening at one end for connecting with said threaded outer surface of said projection, whereby when said base lower portion is connected with a rail, and said insert is engaged within a baluster, said projection is rotatable relative to said base to arrange the baluster at a desired angle with respect to said rail.

2. A rail connector as defined in claim 1, wherein said projection lower portion is cylindrical and said base upper portion is circular.

3. A rail connector as defined in claim 2, wherein said base lower portion includes a lower flange arranged beneath said upper portion opening and said base upper portion includes a pair of spaced arches between which said projection lower portion extends, each of said arches including a flange extending from an outer edge to close said opening.

4. A rail connector as defined in claim 1, wherein said base lower portion contains at least one opening for receiving a fastener.

5. A rail connector as defined in claim 1, wherein said rotatable projection rotates 180 degrees relative to said base.

6. A rail connector as defined in claim 1, wherein said insert has an outer surface corresponding with the configuration of an opening in an end of a baluster, said insert being connected with the baluster via a press-fit connection.

7. A rail connector as defined in claim 6, wherein said insert outer surface includes at least one ridge to increase a compression force on said insert when said insert is pressed into the baluster opening.

* * * * *